US006763857B2

(12) United States Patent
Brown

(10) Patent No.: US 6,763,857 B2
(45) Date of Patent: Jul. 20, 2004

(54) VACUUM ATTACHMENT

(76) Inventor: Roger L. Brown, 7346 S. Seymour Rd., Swartz Creek, MI (US) 48473

( * ) Notice: Subject to any disclaimer, the term of this patent is extended or adjusted under 35 U.S.C. 154(b) by 0 days.

(21) Appl. No.: 10/318,163

(22) Filed: Dec. 13, 2002

(65) Prior Publication Data

US 2004/0112458 A1 Jun. 17, 2004

(51) Int. Cl.[7] ..... B65B 1/04
(52) U.S. Cl. ..... 141/65; 141/114; 141/391
(58) Field of Search ..... 141/64, 114, 10, 141/313–317, 391; 53/432, 433, 434, 510, 511, 512

(56) References Cited

U.S. PATENT DOCUMENTS

| | | | | |
|---|---|---|---|---|
| 3,312,256 A | * | 4/1967 | Reisinger | 141/65 |
| 4,018,253 A | | 4/1977 | Kaufman | |
| 4,750,536 A | | 6/1988 | Grisley | |
| 5,263,520 A | * | 11/1993 | Arai | 141/65 |
| 5,711,136 A | * | 1/1998 | Carcano | 53/434 |
| 5,711,501 A | | 1/1998 | Belokin et al. | |
| 6,093,168 A | | 7/2000 | Mendenhall | |
| 6,644,361 B2 | * | 11/2003 | Otsubo | 141/65 |
| 2002/0092103 A1 | | 7/2002 | Bruno et al. | |

FOREIGN PATENT DOCUMENTS

| | | |
|---|---|---|
| DE | 19959513 | 7/2001 |

* cited by examiner

*Primary Examiner*—Steven O. Douglas
(74) *Attorney, Agent, or Firm*—Richard C. Litman

(57) ABSTRACT

A vacuum attachment for use with a vacuum hose, which is for use with a vacuum device, and a container, particularly any conventional plastic food storage bag. The vacuum attachment has a first attacher for attaching the vacuum attachment to the vacuum hose, and an inserter for inserting the vacuum attachment into the container. The first attacher may be a hollow substantially frustoconical body. The inserter may be a hollow substantially cylindrical neck. The vacuum attachment may also have a second attacher, such as a suction cup, for attaching the vacuum attachment to a planar surface. The vacuum attachment may also have an air flow blocker for blocking the air flow between the container and the vacuum attachment. The air flow blocker may be a hollow substantially cylindrical cap with a closed end. The air flow blocker may have an opening or a filter.

19 Claims, 2 Drawing Sheets

VACUUM ATTACHMENT

BACKGROUND OF THE INVENTION

1. Field of the Invention

The present invention relates to a vacuum attachment adapted for use with a vacuum hose, which is adapted for use with any type of vacuum device, and any type of container, particularly any conventional plastic food storage bag.

2. Description of the Related Art

Many devices have been proposed for the purpose of removing air from a container in order to store and preserve food or in order to reduce the volume of an item, such as clothing, inside a container to facilitate storage. However, these devices are typically expensive and often require the purchase of customized storage bags. Many of the devices include an expensive vacuum unit and cannot be used with a household vacuum that a typical consumer already owns.

Some of the devices include an electrical sealing or heating unit. Some devices with sealing or heating units bear a warning label stating that use of the sealing or heating device with a plastic bag "could cause fumes," which are potentially harmful. Also, these sealing or heating units are known to burn out, rendering the device ineffective.

A variety of devices have been proposed for use with a vacuum device. U.S. Pat. No. 4,018,253, issued Apr. 19, 1977 to Kaufman, describes a home vacuum apparatus for freezer bags. U.S. Pat. No. 4,750,536, issued Jun. 14, 1988 to Grisley, describes a router vacuum attachment. U.S. Pat. No. 6,093,168, issued Jul. 25, 2000 to Mendenhall, describes a breast pump attachment to a household vacuum cleaner.

Further, German Patent No. 19959513 C1, issued Jul. 26, 2001 to Bruno, describes an electric vacuum cleaner attachment with an adapter piece fitted to a suction hose and a filter device extending in a longitudinal direction of the suction hose. U.S. Patent Application Publication No. 2002/0092103 A1, published Jul. 18, 2002 to Bruno et al., describes a universal vacuum extension kit. Also, U.S. Pat. No. 5,711,501, issued Jan. 27, 1998 to Belokin et al., describes a suction cup attachment assembly.

None of the above inventions and patents, taken either singularly or in combination, is seen to describe the instant invention as claimed. Thus a vacuum attachment solving the aforementioned problems is desired.

SUMMARY OF THE INVENTION

The vacuum attachment of the present invention is adapted for use with a vacuum hose which is adapted for use with any type of vacuum device and any type of container, particularly any conventional plastic food storage bag. The vacuum attachment comprises a first attaching means adapted for attaching the vacuum attachment to the vacuum hose, and an inserting means adapted for inserting the vacuum attachment into the container. The first attaching means and the inserting means are preferably integrated into a one-piece construction; however, the first attaching means and the inserting means may be provided as separate pieces which are attached together using any suitable means of attachment.

The first attaching means may comprise a hollow substantially frustoconical body. The inserting means may comprise a hollow substantially cylindrical neck. The vacuum attachment may further comprise a second attaching means, such as a suction cup, adapted for attaching the vacuum attachment to a planar surface. The vacuum attachment may further comprise an air flow blocking means adapted for blocking the air flow between the container and the vacuum attachment. The air flow blocking means may comprise a hollow substantially cylindrical cap with a closed end. The air flow blocking means may comprise an opening or a filter.

Accordingly, it is a principal object of the invention to provide a vacuum attachment for use with a vacuum hose and a container.

It is another object of the invention to provide a vacuum attachment comprising a first attaching means and an inserting means.

It is a further object of the invention to provide a vacuum attachment comprising a hollow substantially frustoconical body.

Still another object of the invention is to provide a vacuum attachment comprising a hollow substantially cylindrical neck.

It is another object of the invention to provide a vacuum attachment comprising a second attaching means.

It is a further object of the invention to provide a vacuum attachment comprising a hollow substantially cylindrical cap.

Still another object of the invention is to provide a vacuum attachment comprising an air flow blocking means comprising an opening or a filter.

It is another object of the invention to provide a vacuum attachment which is adapted for use with a conventional vacuum device.

It is a further object of the invention to provide a vacuum attachment which is adapted for use with a conventional plastic food storage bag.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
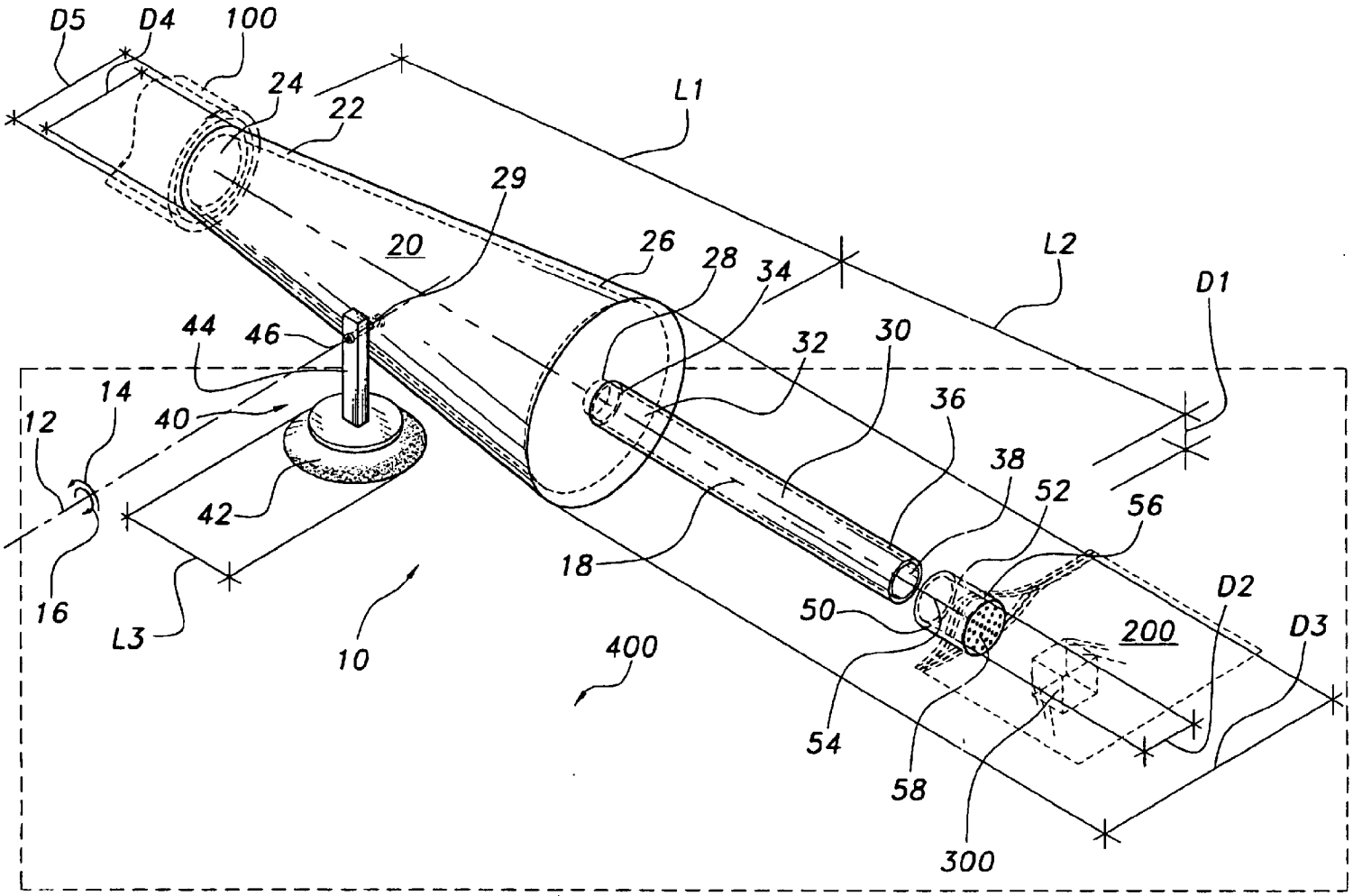
FIG. 1 is an environmental, perspective view of a vacuum attachment according to the present invention.

The present invention is directed to a vacuum attachment, designated generally as 10 in the drawings. The vacuum attachment 10 is adapted for use with a vacuum hose 100 which is adapted for use with any type of vacuum device (not shown) and any type of container 200. The vacuum attachment 10 may be made of any suitable material such as plastic. The vacuum attachment 10 is desirably lightweight and inexpensive to manufacture. The vacuum attachment 10 may desirably be manufactured without moving parts, which makes the vacuum attachment 10 durable and long-lasting.

The vacuum attachment 10 is easy to operate and may be used with any household vacuum, particularly a household vacuum with a hose connection. In order to use the vacuum attachment 10 of the present invention, one simply connects the vacuum attachment 10 to the vacuum hose 100, inserts the vacuum attachment 10 into the container 200, and turns the vacuum device on. Once air is removed from the container 200, the container 200 may be closed and sealed with an integrated interlocking closure (such as that found on ZIPLOC brand bags or the like) or with any other suitable means of closure.

Unlike many of the prior art devices, there are no lids to close, no buttons to push, and no electrical cords to connect. The vacuum attachment 10 of the present invention does not require electrical hot wires which may cause harmful fumes. The vacuum attachment 10 of the present invention is easy to clean in a dishwasher or in a sink.

The container 200 may be any type of container including, but not limited to, a plastic bag for food storage, a plastic bag for storage of clothing, or an inflatable object such as an inflatable mattress. The vacuum attachment 10 of the present invention may be used with any conventional plastic food storage bag including, for example, ZIPLOC brand food storage bags or the like, bread bags, hot dog or hamburger bun bags, and the like. In other words, the customized storage bags of the prior art are not required to store and preserve food or reduce the volume of clothing for storage. In most situations, the container 200 may contain an item 300. The item 300 may be, for example, food or clothing.

When the vacuum device is operated in a vacuum mode, the vacuum attachment 10 of the present invention allows a user to easily remove the air from the container 200. The removal of air from the container 200 is desirable for storing, preserving and/or freezing food. Also, the removal of air from the container 200 is desirable for reducing the volume of the item 300 to be stored, which may be food, clothing, blankets, comforters, and the like. The vacuum device may, optionally, be reversible and have a vacuum mode and an inflation mode. As such, when the vacuum device is operated in the inflation mode, the vacuum attachment 10 facilitates the insertion of air into the container 200 and/or the item 300.

In a first embodiment, a vacuum attachment 10, as shown in FIG. 1, is adapted for a vacuum hose 100 and a container 200. The vacuum attachment 10 comprises a first attaching means adapted for attaching the vacuum attachment 10 to the vacuum hose 100, and an inserting means adapted for inserting the vacuum attachment 10 into the container 200. The first attaching means may be any suitable device for attaching the vacuum attachment 10 to the vacuum hose 100 of the vacuum device. The first attaching means is desirably adapted to fit vacuum hoses of different sizes and shapes.

Although the first attaching means is shown in FIG. 1 with a circular cross-section, the first attaching means may be provided in any suitable shape which matches the shape of the vacuum hose 100. Although the first attaching means is shown in FIG. 1 as adapted to be inserted into the vacuum hose 100, the first attaching means may also be adapted so that the vacuum hose 100 is inserted inside the first attaching means.

The inserting means may be any suitable device for inserting the vacuum attachment 10 into the container 200. The inserting means is desirably adapted to fit containers of different sizes and shapes. Although the inserting means is shown in FIG. 1 with a circular cross-section, the inserting means may be provided in any suitable shape.

In a second embodiment, the vacuum attachment 10 comprises all the features of the first embodiment, and the first attaching means comprises a hollow substantially frustoconical body 20. The hollow substantially frustoconical body 20 is desirable in that it is adapted for attachment to vacuum hoses of different sizes, for example, small hoses with a 1 diameter to shop vacuum size hoses with a 2½" diameter. The body 20 is hollow to permit the passage of air through the vacuum attachment 10.

The body 20 may comprise a first opening 24 at a first end 22 and a second opening 28 at a second end 26, where the first opening 24 permits the passage of air between the vacuum hose 100 and the vacuum attachment 10, and where the second opening 28 permits the passage of air between the body 20 and the inserting means.

In a third embodiment, the vacuum attachment 10 comprises all the features of the second embodiment, and the body 20 has a first body end 22 with a first body outside diameter D4, the body 20 has a second body end 26 with a second body outside diameter D3, and the first body outside diameter D4 is less than the second body outside diameter D3. As such, the body 20 is adapted for attachment to any vacuum hose 100 with a vacuum hose inside diameter D5 which is greater than the first body outside diameter D4 and less than second body outside diameter D3.

In a fourth embodiment, the vacuum attachment 10 comprises all the features of the first embodiment, wherein the inserting means comprises a hollow substantially cylindrical neck 30. The hollow substantially cylindrical neck 30 is desirable in that it is adapted for insertion into containers of different sizes. Further, the cross-sectional area of the neck 30 may be smaller than the cross-sectional area of the second end 26 of the body 20 and the vacuum hose 100 thus adapting the vacuum device for use with a container 200 with a small opening. Also, the present inventor has found that the smaller cross-sectional area of the neck 30 creates a desirable suction for removing air from the container 200.

The neck 30 may comprise a first opening 34 at a first end 32 and a second opening 38 at a second end 36, where the first opening 34 permits the passage of air between the body 20 and the neck 30, and where the second opening 38 permits the passage of air between the neck 30 and the container 200 and/or the air flow blocking means (described below). The vacuum attachment 10 may be used without the air flow blocking means (described below), particularly for large food items 300 such as steak, chicken, corn on the cob, fish, venison, and the like, or large items such as clothing or blankets.

In a fifth embodiment, the vacuum attachment 10 comprises all the features of the first embodiment, and the vacuum attachment 10 further comprises a second attaching means adapted for attaching the vacuum attachment 10 to a planar surface 400. The second attaching means is any suitable device for attaching the vacuum attachment 10 to the planar surface 400. The planar surface 400 may be a table top, a counter top, or any suitable work surface.

The second attaching means is desirably a temporary means of attachment to the planar surface 400, such as a suction device 40, a hook and loop connector (not shown), or a snap fit connector (not shown). The second attaching means is desirably provided on the side of the body 20 of the vacuum attachment 10; however, the second attaching means may be attached to the vacuum attachment 10 at any suitable location.

In a sixth embodiment, the vacuum attachment 10 comprises all the features of the fifth embodiment, wherein the second attaching means comprises a suction cup 42. The suction cup 42 may be attached directly to the vacuum attachment 10. The suction cup 42 may, alternately, be attached to the vacuum attachment 10 via a shaft 44 and a means of rotational attachment, such as a pop rivet 46. The means of rotational attachment may be attached to the vacuum attachment via an opening 29 in the vacuum attachment 10, which may be provided in the body 20 of the vacuum attachment 10. The present inventor has found that a single suction cup 42 is sufficient to secure the vacuum attachment 10 to the planar surface 400 and sufficient to prevent the vacuum attachment 10 from falling over.

In a seventh embodiment, the vacuum attachment 10 comprises all the features of the first embodiment, and the vacuum attachment 10 further comprises an air flow blocking means adapted for blocking the air flow between the container 200 and the vacuum attachment 10. The air flow blocking means may be any suitable device for blocking the air flow between the container 200 and the vacuum attachment 10. The air flow blocking means may be an integral part of the inserting means or the air flow blocking means may be a separate piece which is attached to the inserting means using any suitable means of attachment, such as a frictional attachment or a snap fit connection. If the air flow blocking means is a separate component, the attachment between the air flow blocking means and the inserting means is desirably temporary yet sufficient to securely maintain the attachment of the air flow blocking means and the inserting means during operation of the vacuum attachment 10.

The air flow blocking means is desirable, in particular, when the vacuum attachment 10 is used to remove the air from a container 200 containing an item 300, where the item 300 includes small diameter or particulate matter, or possibly liquids. For example, the air flow blocking means is desirable when using the vacuum attachment 10 to remove the air from a container 200 containing raisins, peanuts, popcorn, or anything smaller than the inside diameter of the inserting means. The air flow blocking means permits air to be removed from the container 200 without allowing the small diameter or particulate matter, or liquid, to pass into the vacuum attachment 10, the vacuum hose 100, or the vacuum device.

In an eighth embodiment, the vacuum attachment 10 comprises all the features of the seventh embodiment, and the air flow blocking means is adapted for attachment to the inserting means. For example, the inserting means may be provided with an inserting means outside diameter D1, and the air flow blocking means may be provided with an air flow blocking means inside diameter D2, where the inserting means outside diameter D1 is less than or equal to the air flow blocking means inside diameter D2. This configuration permits the user of the vacuum attachment 10 to slide the air flow blocking means onto the inserting means in frictional engagement. Other suitable means of attachment may be utilized.

In a ninth embodiment, the vacuum attachment 10 comprises all the features of the seventh embodiment, wherein the air flow blocking means comprises a hollow substantially cylindrical cap 50. The hollow substantially cylindrical cap 50 is desirable in that it is adapted for temporary, removable, frictional attachment with the inserting means 30. The cap 50 may comprise a first end 52 with a first opening 54 and a closed end 56. The first opening 54 permits the passage of air between the cap 50 and the inserting means. The closed end 56 comprises a means of restricting the passage of air between the cap 50 and the container 200.

In a tenth embodiment, the vacuum attachment 10 comprises all the features of the seventh embodiment, where the air flow blocking means comprises a closed end 56, and the closed end 56 comprises one or more openings 58. The one or more openings 58 permit air to be removed from the container 200 without allowing small diameter matter (see above) inside the container 200 to pass into the vacuum attachment 10, the vacuum hose 100, or the vacuum device.

Figure 2:
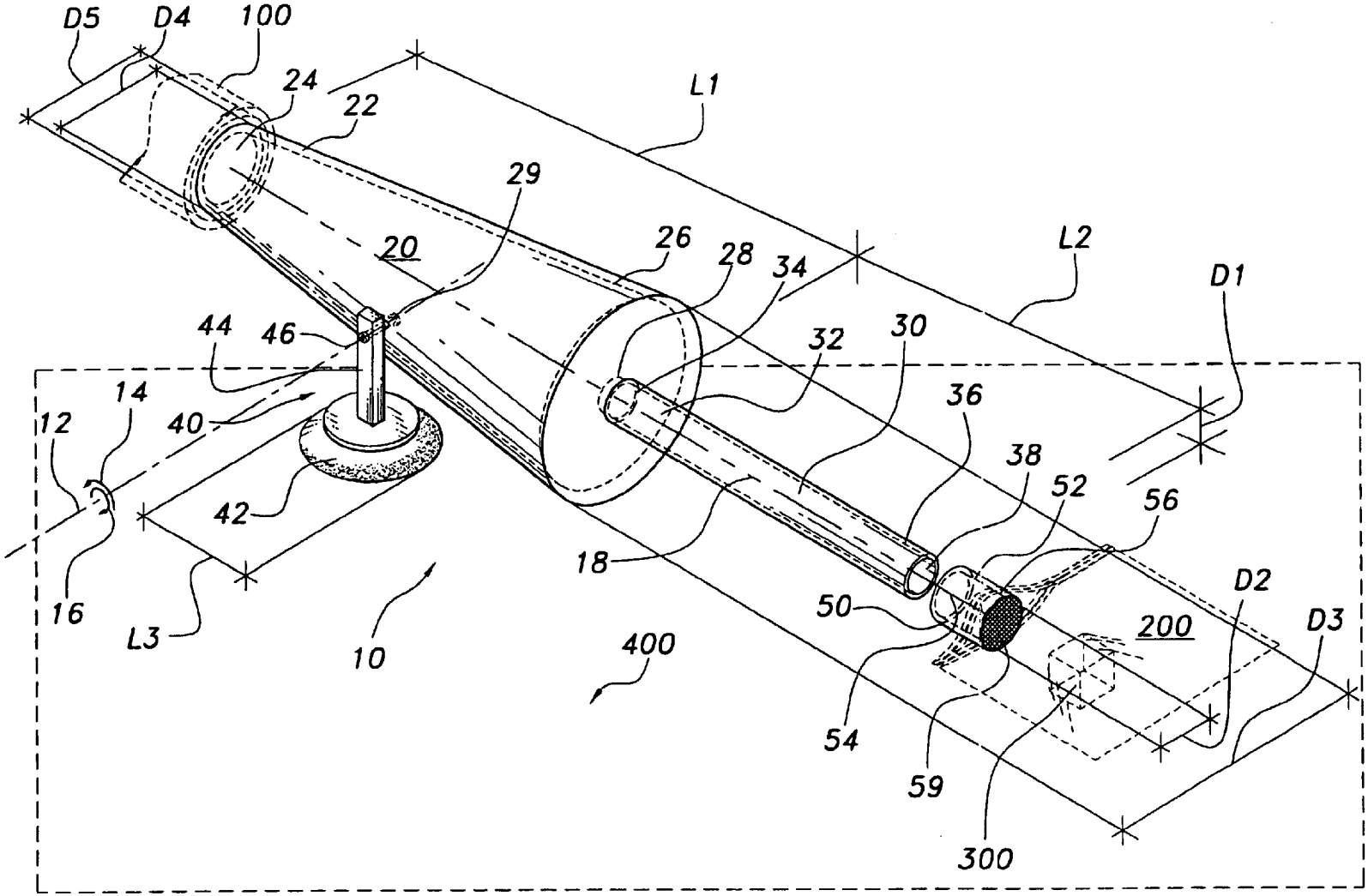
FIG. 2 is an environmental, perspective view of an alternate embodiment of a vacuum attachment according to the present invention.

In an eleventh embodiment, as shown in FIG. 2, the vacuum attachment 10 comprises all the features of the seventh embodiment, where the air flow blocking means comprises a closed end 56, and the closed end 56 comprises a filter 59. The filter 59 may be any suitable device for filtering the air passing through the vacuum attachment 10, such as a sheet filter, a screen, a porous material, and the like. The filter 59 permits air to be removed from the container 200 without allowing particulate matter, or possibly liquids, inside the container 200 to pass into the vacuum attachment 10, the vacuum hose 100, or the vacuum device.

In a twelfth embodiment, the vacuum attachment 10 comprises all the features of the first embodiment, where the vacuum attachment 10 has a longitudinal axis 18, the vacuum attachment 10 has an axis of rotation 12 perpendicular to the longitudinal axis 18, and the vacuum attachment 10 is adapted to rotate about the axis of rotation 12 in a first direction 14 and in a second direction 16. The axis of rotation 12 may pass through the means of rotational attachment described in the sixth embodiment. By adapting the vacuum attachment 10 to rotate about the axis of rotation 12, the vacuum attachment 10 is easier to use in that the inserting means end of the vacuum attachment 10 can be moved up and down in order to match up with the opening of the container 200.

In a thirteenth embodiment, the vacuum attachment 10 comprises all the features of the first, second, fourth, fifth and seventh embodiments.

In a fourteenth embodiment, the vacuum attachment 10 comprises all the features of the fifth embodiment, and the first attachment means has a first length L1, and the second attaching means has a third length L3, where the ratio of the third length L3 to the first length L1 is about 1:3. The present inventor has found that this ratio assures sufficient stability to the vacuum attachment 10 during use. For example, the first length L1 may be about 5½" and the third length L3 may be about 1¾".

In a fifteenth embodiment, the vacuum attachment 10 comprises all the features of the fifth embodiment, wherein the inserting means has a second length L2, and the second attaching means has a third length L3, where the ratio of the third length L3 to the second length L2 is about 1:3. Similarly, the present inventor has found that this ratio assures sufficient stability to the vacuum attachment 10 during use. For example, the second length L2 may be about 5¼" and the third length L3 may be about 1¾".

In a sixteenth embodiment, the vacuum attachment 10 comprises all the features of the first embodiment, where the first attaching means comprises a hollow substantially frustoconical body 20, the body 20 has a first body end 22 with a first body outside diameter D4, the body 20 has a second body end 26 with a second body outside diameter D3, the first body outside diameter D4 is less than the second body outside diameter D3, the vacuum attachment 10 further comprises an air flow blocking means adapted for blocking the air flow between the container 200 and the vacuum attachment 10, the air flow blocking means is adapted for attachment to the inserting means, and the ratio of the inserting means outside diameter D1 to the first body outside diameter D4 is about 1:2. The present inventor has found that this ratio facilitates providing a desirable suction to the vacuum attachment 10 for removing air from the container 200. For example, the inserting means outside diameter D1 may be about ½ and the first body outside diameter D4 may be about 1".

In a seventeenth embodiment, the vacuum attachment 10 comprises all the features of the first embodiment, where the first attaching means comprises a hollow substantially frustoconical body 20, the body 20 has a first body end 22 with a first body outside diameter D4, the body 20 has a second body end 26 with a second body outside diameter D3, the first body outside diameter D4 is less than the second body outside diameter D3, the vacuum attachment 10 further comprises an air flow blocking means adapted for blocking the air flow between the container 200 and the vacuum attachment 10, the air flow blocking means is adapted for attachment to the inserting means, and the ratio of the inserting means outside diameter D1 to the second body outside diameter D3 is about 1:5. The present inventor has found that this ratio facilitates providing a desirable suction to the vacuum attachment 10 for removing air from the container 200. For example, the inserting means outside diameter D1 may be about ½ and the second body outside diameter D3 may be about 2⅜".

In an eighteenth embodiment, as shown in FIGS. 1 and 2, the vacuum attachment 10 comprises all the features of the first, second, third, fourth, fifth, sixth, seventh, ninth, tenth, eleventh and twelfth embodiments.

In a nineteenth embodiment, the vacuum attachment 10 comprises all the features of the fourteenth and fifteenth embodiments.

In a twentieth embodiment, the vacuum attachment 10 comprises all the features of the sixteenth and seventeenth embodiments.

In one preferred embodiment, the vacuum attachment 10 has the following dimensions: the first length L1 is about 5½", the second length L2 is about 5¼", the third length L3 is about 1¾", the inserting means outside diameter D1 is about ½", the air flow blocking means inside diameter D2 is slightly larger than about ½", the second body outside diameter D3 is about 2⅜", and the first body outside diameter D4 is about 1". The vacuum attachment 10 of the preferred embodiment is adapted for a vacuum hose 100 with a vacuum hose inside diameter D5 of between about 1" and about 2⅜". The preferred embodiment is inexpensive to manufacture, made of durable plastic, under 12" in total length and less than about 3 ounces in weight.

It is to be understood that the present invention is not limited to the embodiments described above, but encompasses any and all embodiments within the scope of the following claims.

I claim:

1. A vacuum attachment adapted for a vacuum hose and a container, the vacuum attachment comprising:

a first attaching means adapted for attaching the vacuum attachment to the vacuum hose;

a second attaching means adapted for attaching the vacuum attachment to a planar surface; and an inserting means adapted for inserting the vacuum attachment into the container.

2. The vacuum attachment of claim 1, wherein the first attaching means comprises a hollow substantially frustoconical body.

3. The vacuum attachment of claim 2, wherein the body has a first body end with a first body outside diameter;

wherein the body has a second body end with a second body outside diameter; and wherein the first body outside diameter is less than the second body outside diameter.

4. The vacuum attachment of claim 1, wherein the inserting means comprises a hollow substantially cylindrical neck.

5. The vacuum attachment of claim 1, wherein the second attaching means comprises a suction cup.

6. The vacuum attachment of claim 1, wherein the vacuum attachment further comprises an air flow blocking means adapted for blocking the air flow between the container and the vacuum attachment.

7. The vacuum attachment of claim 6, wherein the air flow blocking means is adapted for attachment to the inserting means.

8. The vacuum attachment of claim 6, wherein the air flow blocking means comprises a hollow substantially cylindrical cap.

9. The vacuum attachment of claim 6, wherein the air flow blocking means comprises a closed end; and wherein the closed end comprises one or more openings.

10. The vacuum attachment of claim 6, wherein the air flow blocking means comprises a closed end; and wherein the closed end comprises a filter.

11. The vacuum attachment of claim 1, wherein the vacuum attachment has a longitudinal axis;

wherein the vacuum attachment has an axis of rotation perpendicular to the longitudinal axis; and wherein the vacuum attachment is adapted to rotate about the axis of rotation in a first direction and in a second direction.

12. The vacuum attachment of claim 1, wherein the first attaching means comprises a hollow substantially frustoconical body;

wherein the inserting means comprises a hollow substantially cylindrical neck;

wherein the vacuum attachment further comprises a second attaching means adapted for attaching the vacuum attachment to a planar surface;

wherein the vacuum attachment further comprises an air flow blocking means adapted for blocking the air flow between the container and the vacuum attachment; and wherein the air flow blocking means is adapted for attachment to the inserting means.

13. The vacuum attachment of claim 1, wherein the first attachment means has a first length;

wherein the second attaching means has a third length; and wherein the ratio of the third length to the first length is about 1:3.

14. The vacuum attachment of claim 1, wherein the inserting means has a second length;

wherein the second attaching means has a third length; and wherein the ratio of the third length to the second length is about 1:3.

15. The vacuum attachment of claim 1, wherein the first attaching means comprises a hollow substantially frustoconical body;

wherein the body has a first body end with a first body outside diameter;

wherein the body has a second body end with a second body outside diameter;

wherein the first body outside diameter is less than the second body outside diameter;

wherein the vacuum attachment further comprises an air flow blocking means adapted for blocking the air flow between the container and the vacuum attachment;

wherein the air flow blocking means is adapted for attachment to the inserting means; and wherein the ratio of the inserting means outside diameter to the first body outside diameter is about 1:2.

16. The vacuum attachment of claim 1, wherein the first attaching means comprises a hollow substantially frustoconical body;

wherein the body has a first body end with a first body outside diameter;

wherein the body has a second body end with a second body outside diameter;

wherein the first body outside diameter is less than the second body outside diameter;

wherein the vacuum attachment further comprises an air flow blocking means adapted for blocking the air flow between the container and the vacuum attachment;

wherein the air flow blocking means is adapted for attachment to the inserting means; and wherein the ratio of the inserting means outside diameter to the second body outside diameter is about 1:5.

17. The vacuum attachment of claim 1, wherein the first attaching means comprises a hollow substantially frustoconical body;

wherein the body has a first body end with a first body outside diameter;

wherein the body has a second body end with a second body outside diameter;

wherein the first body outside diameter is less than the second body outside diameter;

wherein the inserting means comprises a hollow substantially cylindrical neck;

wherein the vacuum attachment further comprises a second attaching means adapted for attaching the vacuum attachment to a planar surface;

wherein the second attaching means comprises a suction cup;

wherein the vacuum attachment further comprises an air flow blocking means adapted for blocking the air flow between the container and the vacuum attachment;

wherein the air flow blocking means is adapted for attachment to the inserting means;

wherein the air flow blocking means comprises a hollow substantially cylindrical cap;

wherein the air flow blocking means comprises a closed end;

wherein the closed end comprises an opening or a filter;

wherein the vacuum attachment has a longitudinal axis;

wherein the vacuum attachment has an axis of rotation perpendicular to the longitudinal axis; and wherein the vacuum attachment is adapted to rotate about the axis of rotation in a first direction and in a second direction.

18. A vacuum attachment adapted for a vacuum hose and a container, the vacuum attachment comprising:

a first attaching means adapted for attaching the vacuum attachment to the vacuum hose; and an inserting means adapted for inserting the vacuum attachment into the container;

wherein the vacuum attachment further comprises a second attaching means adapted for attaching the vacuum attachment to a planar surface;

wherein the first attachment means has a first length;

wherein the inserting means has a second length;

wherein the second attaching means has a third length;

wherein the ratio of the third length to the first length is about 1:3; and wherein the ratio of the third length to the second length is about 1:3.

19. A vacuum attachment adapted for a vacuum hose and a container, the vacuum attachment comprising:

a first attaching means adapted for attaching the vacuum attachment to the vacuum hose; and an inserting means adapted for inserting the vacuum attachment into the container;

wherein the first attaching means comprises a hollow substantially frustoconical body;

wherein the body has a first body end with a first body outside diameter;

wherein the body has a second body end with a second body outside diameter;

wherein the first body outside diameter is less than the second body outside diameter;

wherein the vacuum attachment further comprises an air flow blocking means adapted for blocking the air flow between the container and the vacuum attachment;

wherein the air flow blocking means is adapted for attachment to the inserting means;

wherein the ratio of the inserting means outside diameter to the first body outside diameter is about 1:2; and wherein the ratio of the inserting means outside diameter to the second body outside diameter is about 1:5.

* * * * *